US008156773B1

(12) United States Patent
Olson et al.

(10) Patent No.: US 8,156,773 B1
(45) Date of Patent: Apr. 17, 2012

(54) MANHOLE COVER LOCKS

(76) Inventors: Rodney G. Olson, Yorkville, IL (US); Dean Gramly, Delavan, WI (US); Brad S. Gramly, Darien, WI (US); Andrew Brovold, Darien, WI (US); Scott J. Emmerich, Delavan, WI (US)

( * ) Notice: Subject to any disclaimer, the term of this patent is extended or adjusted under 35 U.S.C. 154(b) by 368 days.

(21) Appl. No.: 12/483,564

(22) Filed: Jun. 12, 2009

(51) Int. Cl.
*B65D 55/14* (2006.01)

(52) U.S. Cl. ..... 70/168; 70/169

(58) Field of Classification Search ..... 70/163, 70/166–169; 411/910
See application file for complete search history.

(56) References Cited

U.S. PATENT DOCUMENTS

| | | | | | |
|---|---|---|---|---|---|
| 887,591 | A | * | 5/1908 | Cook | 137/371 |
| 1,430,707 | A | * | 10/1922 | Weaver | 70/260 |
| 1,473,986 | A | | 11/1923 | Brown | |
| 1,590,811 | A | * | 6/1926 | Craddock | 70/168 |
| 1,684,983 | A | * | 9/1928 | Clark | 292/304 |
| 1,704,854 | A | * | 3/1929 | Burgess | 292/302 |
| 1,891,961 | A | * | 12/1932 | Taylor | 70/169 |
| 1,902,731 | A | * | 3/1933 | Sherman | 70/169 |
| 1,992,759 | A | * | 2/1935 | Nehls | 301/108.1 |
| 2,018,534 | A | * | 10/1935 | Rike | 220/86.1 |
| 2,060,337 | A | * | 11/1936 | Nehls | 70/168 |
| 2,693,100 | A | * | 11/1954 | Wiegel | 70/168 |
| 3,136,148 | A | * | 6/1964 | Nehls | 70/169 |
| 3,980,329 | A | * | 9/1976 | Coe | 292/258 |
| 3,998,353 | A | * | 12/1976 | Farelli | 220/210 |
| 4,029,370 | A | * | 6/1977 | Ziegel et al. | 312/284 |
| 4,096,481 | A | * | 6/1978 | Widmer et al. | 343/715 |
| 4,468,064 | A | * | 8/1984 | McAdams, Sr. | 296/224 |
| 4,562,709 | A | * | 1/1986 | Canadas et al. | 70/169 |
| 4,577,478 | A | * | 3/1986 | Economopoulos et al. | 70/168 |
| 4,964,755 | A | * | 10/1990 | Lewis et al. | 404/25 |
| 5,082,392 | A | | 1/1992 | Marchese | |
| 5,324,135 | A | | 6/1994 | Smith | |
| 6,199,414 | B1 | * | 3/2001 | Chang | 70/168 |
| 6,341,927 | B2 | * | 1/2002 | Hampson et al. | 411/403 |
| 6,732,555 | B1 | * | 5/2004 | Nielsen | 70/169 |
| 6,854,922 | B1 | | 2/2005 | Nicks | |
| 6,881,007 | B2 | | 4/2005 | Dennis | |
| 7,201,533 | B2 | * | 4/2007 | DeGreef | 404/25 |
| 7,204,508 | B1 | * | 4/2007 | Hsai | 280/507 |
| 7,320,236 | B2 | * | 1/2008 | Monneret et al. | 70/169 |
| 7,377,141 | B2 | * | 5/2008 | Javaux et al. | 70/168 |
| 7,425,112 | B2 | * | 9/2008 | Nowak, Jr. | 411/402 |
| 7,484,908 | B2 | * | 2/2009 | Stadler | 404/25 |
| 2002/0148260 | A1 | * | 10/2002 | Garguilo | 70/168 |
| 2003/0019259 | A1 | * | 1/2003 | Nicodemus et al. | 70/233 |
| 2004/0069024 | A1 | * | 4/2004 | Hauer et al. | 70/167 |
| 2004/0148985 | A1 | * | 8/2004 | Swanson | 70/225 |
| 2006/0201213 | A1 | * | 9/2006 | Burke et al. | 70/168 |
| 2007/0081856 | A1 | * | 4/2007 | DeGreef | 404/25 |
| 2008/0168808 | A1 | * | 7/2008 | Neuber | 70/167 |
| 2008/0256997 | A1 | * | 10/2008 | Nolle et al. | 70/167 |

* cited by examiner

*Primary Examiner* — Suzanne Barrett
(74) *Attorney, Agent, or Firm* — Patnaude & Videbeck

(57) ABSTRACT

Improved manhole cover locks are disclosed that fit into existing access recesses in the covers and engage the rim of the manhole cover housing at one end thereof and latchingly engage the underside of the manhole cover thereof. A tamper proof bolt provides adjustability to the latch from the top of the lock.

7 Claims, 3 Drawing Sheets

MANHOLE COVER LOCKS

This invention relates to locks and locking devices and, more particularly, to locking devices for securing several manhole covers in their respective housings, when each manhole may have a differing size access hole adjacent the outer edge thereof.

BACKGROUND OF THE INVENTION

Manholes and manhole covers are everywhere that civilization has infrastructure. They are basic to both storm sewer and sewage structure. Additionally, underground utility lines of all sorts are accessed for maintenance, repair and replacement by the use of manholes topped by metal or concrete rings or housings on which a manhole cover is mounted.

Traditionally, the weight of a manhole cover has been considered sufficient to maintain them on their mountings. However, in many parts of the world, the metal content of the manhole cover is considered worth stealing by the locals. Further, in this age of terrorism, improvised explosive devices (IED) planted by the side of a road are a main weapon of a lawless group. The positioning of manholes and their covers along roadways would provide such groups with an unwarranted convenience if the manhole covers were not locked down.

Through the years, manhole covers and their mounting rings have been generally cylindrical or rectangular in nature, with cylindrical being the preferred shape. While the design patterns of the tops of manhole covers may vary, as with vent holes, cross bars, or the like, a substantial number of manhole covers have a U-shaped access hole adjacent the outer circumference of the manhole cover in a large access hole, or about ⅞×¾ inch in a smaller access hole of a "concealed pickhole" manhole cover. These holes, due to casting, generally have a slight draft or acute angle from the horizontal, as does an inner lip of a cast manhole cover housing.

Patents that require a specially made manhole cover or rim that includes a locking apparatus include U.S. Pat. Nos. 1,473,986; 4,964,755; 5,082,392; 5,324,135; 6,199,414; and 6,854,922. Lock mechanisms that may work with standard manhole covers include U.S. Pat. Nos. 3,980,329; 6,881,007; and Publication 2007/0081856.

A need has developed for a less expensive, more generally useful manhole cover lock that is usable on existing designed manhole covers of differing general configurations.

SUMMARY OF THE INVENTION

It is an object of the present invention, generally stated, to provide a new and improved manhole cover lock usable on existing designs of manhole covers. Another object of the present invention is the provision of a manhole cover lock assembly that is capable of being utilized on opposing sides of a "concealed pickhole" manhole cover.

The invention resides in a manhole cover lock that comprises a body positionable in an access recess of a manhole cover. The body engages a rim of housing for the manhole cover, and further includes a latch pivotally mounted on the body for moving from a retracted position to an extended position engaging an underside of the manhole cover. The invention further resides in a tamper proof fastener that comprises an elongate shaft having an enlarged head at the top thereof, the head includes at least two recesses formed along a periphery thereof inwardly extending from a side and a top thereof, the angular relation between the recesses around the head is changeable between respective ones of the bolts for preventing unwarranted turning of the fastener.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

DETAILED DESCRIPTION OF THE PREFERRED EMBODIMENTS

Figure 1:
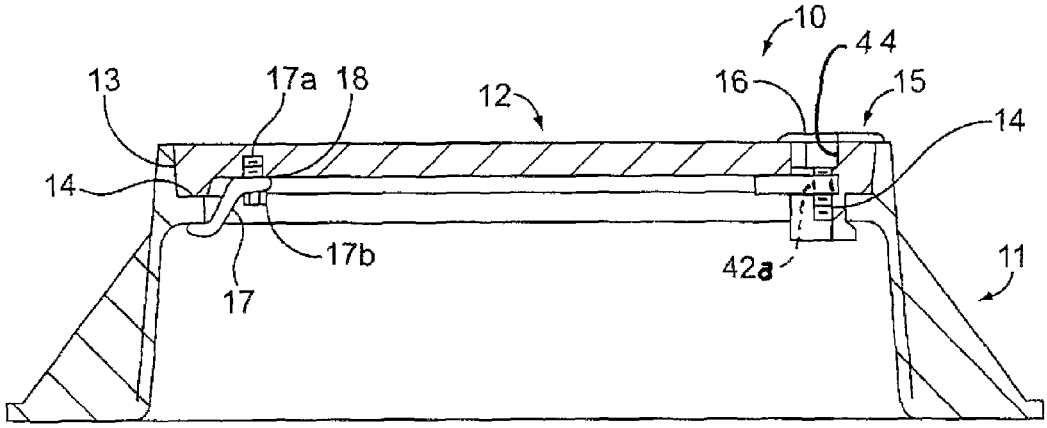
FIG. 1 is a vertical sectional view of a manhole cover and its associated housing including a manhole cover lock constructed in accordance with the present invention.

Referring to FIG. 1, a standardized manhole cover and rim or housing assembly, generally indicated at 10, includes an annular rim, generally indicated at 11, on which a circular manhole cover, generally indicated at 12, is matingly mounted. Typically, they are made of cast iron. The circumferential edge 13 of the manhole cover 12 matingly engages a hollow L-shaped rim 14 at the top of housing 11. A first embodiment of a manhole cover lock assembly constructed in accordance with the invention, generally indicated at 15, fits in a U-shape recess 16, about 2½ inches by 2½ inches adjacent the circumferential edge of the manhole cover and fits between that recess 16 and the L-shape rim 14 of the housing 11.

Approximately 180 degrees around the circumference 13 of manhole cover 12 is positioned an S-shape foot, generally indicated at 17, that is preferably bolted and also bonded to the underside of the manhole cover 12 with a resin/catalyst type adhesive 18. The manhole cover may be drilled and threaded at 17*a* from the bottom of the cover upward to provide a mounting for threaded bolt 17. The distal end of foot 17 provides securement of the distal end of foot 17 around the lip 14 of the housing 11.

Referring to FIGS. 1 and 3-5, the latch portion of the manhole cover lock 15 includes a substantially flat thin top 20 made of hardened or spring steel and having a beveled edge 21 therearound to prevent prying. Subjacent the generally flat top is a body portion, generally indicated at 22, the top segment of which is shaped similarly to the U-shape recess 16 adjacent the perimeter of the manhole cover 12 with its outermost edge generally matingly engaging the rim 13 immediately outwardly adjacent the U-shape recess 16. While the body 22 of the lock assembly 15 may be made of differing hard materials suitable for locks, we have found that, in operation, a very tough molded part may be made of polytetrafluoroethylene (PTFE). While the top portion 23 of body 22 includes a generally rectangular cutout 24 is defined by top surface 25 vertical flat surface 26 and beveled lip 27 that fits around the bottom portion of the L-shape rim 14 as shown most clearly in FIGS. 3 and 4. The body portion, generally indicated at 22, includes a pair of vertical bores 30 and 31 therethrough that are aligned with apertures 19*a*-19*b* in the top plate 20 such that ⅜ inch rivets 32 and 33 securely affix the top beveled plate 20 to the body 22. A small recess 37 in the beveled foot 28 provides access for an installer to spread the end of the rivet.

Semicircular recess 30 forms a part and portion of a larger recess 40 opposite the lower portion of body 24 from the generally rectangular recess defined by sides 25, 26 and 27. The recess 40 provides a swivelable home for latch 42 that is threadedly engaged on hardened bolt 43. A third vertical bore 44 in the upper portion of body 22 (FIG. 1) provides a rotatable mounting for bolt 43 with the top or head 43*a* thereof maintained at the top of body 22 subjacent the third bore 19*c* in top cover 20. Elongate latch 42 includes a threaded bore 42*a* therethrough in which bolt 43 is threaded. The bottom 43*b* of bolt 43 has its threads interrupted such that latch 42 may not be removed from its threaded mounting in bolt 43. Also, the interrupted threads at the bottom 43*b* of bolt 43 assure that the latch will turn when desired by rotating the head 43*a* of bolt 43.

With the latch in its retracted position within the outline of recess 40, the body 22 of the manhole cover lock 15 may be moved downwardly through the U-shaped recess 16 adjacent the perimeter of manhole cover 12 and through the hole therebelow such that the foot 28 of the recess 24*a* in lower body portion 24 may be positioned around the foot of the L-shape rim 14. With the top plate flat on top of the manhole cover, the latch 42 may then be rotated outwardly of its recess 40 to engage the bottom side of manhole cover 12 to fully engage the latch thereunder and lock the lock 15 to prevent removal of the manhole cover 12 from its housing 11 on both sides of the housing. Once the latch is moved outwardly, its position is restricted by the vertical wall of recess 40 as the latch 42 is drawn upwardly until it meets the top wall 40*a* of recess 40 which should approximate the thickness of the manhole cover 12 to engage the distal end of lock 42 against the bottom of manhole cover 12.

Thereafter, the aperture 19*c* of top plate 20 may be potted with a hardenable material to prevent access to the head 43*a* of bolt 43. Also, the head 43*a* may have a proprietary or non-standard recess therein that would prevent turning the bolt by unauthorized personnel even if the potted material were removed from recess 19*c*.

Figure 3:
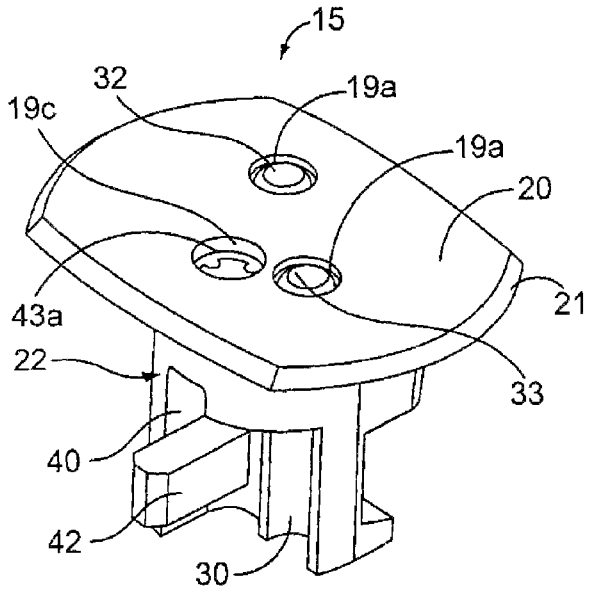
FIG. 3 is a top ¾ perspective view of the first embodiment of the present invention.
Figure 3A:
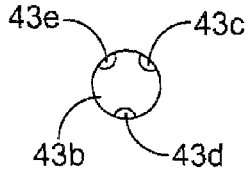
FIG. 3*a* is a top plan view of the bolt shown in FIG. 3.
Figure 3B:
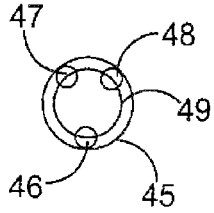
FIG. 3*b* is a top plan view of a wrench for the bolt shown in FIGS. 3 and 3*a;*
Figure 4:
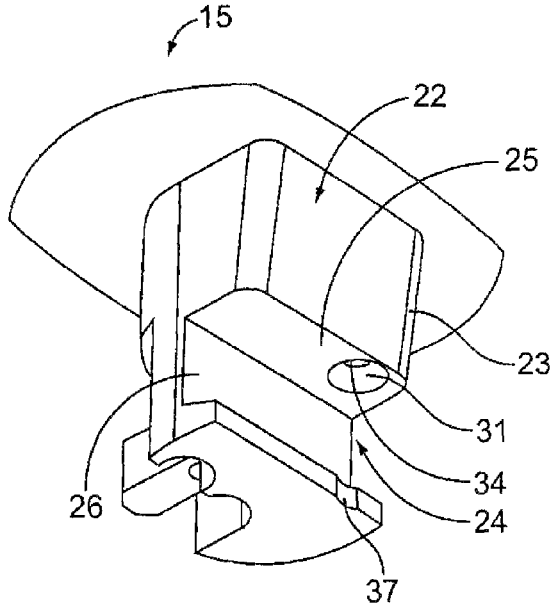
FIG. 4 is a bottom ¾ perspective view of the first embodiment of the present invention.
Figure 5:
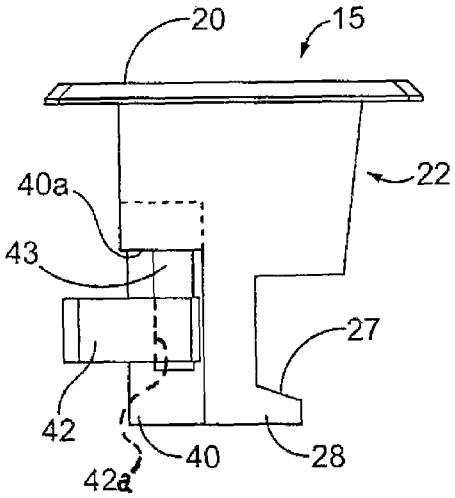
FIG. 5 is an end elevational view of the first embodiment of the present invention.
Figure 6:
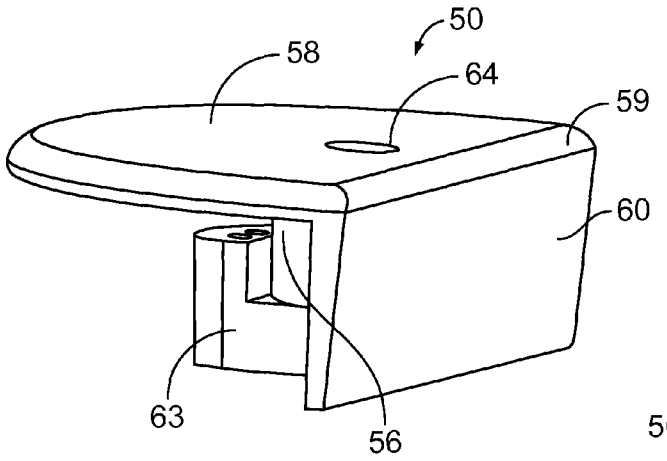
FIG. 6 is a top ¼ perspective view of the second embodiment of the present invention.

Referring to FIGS. 3*a* and 3*b*, top views of the head 43*a* of bolt 43 is shown as having three equally spaced semicircular recesses 43*b*, 43*c*, 43*d*. FIG. 3*b* shows the top of a wrench 45 suitable for tightening and loosening the bolt 43. A round metal bar having the outer circumference 45 which is a slip fit into aperture 19*c* or aperture 64 is drilled for positioning smaller bars 46, 47, 48 respectively, in the holes drilled therein so as to extend from the top thereof approximately the depth of recesses 43*c*, 43*d* and 43*e*. The combination is then turned, in this embodiment, in a lathe so as to remove the outer portions of smaller bars 46, 47 and 48 until the diameter of the tool is that shown at 49, which is substantially identical to the outer circumference 43*b* of bolt head 43.

As so constructed, with any type of handle on the opposite end of wrench 45, the wrench may be utilized to tighten, loosen, or turn the bolts 43 and 61 as shown in the present preferred embodiments. In another aspect of the present invention, the location of the recesses 43*c*, 43*d* and 43*e* may be moved around the periphery of the bolt head 43*b* to provide a plurality of unique bolts for each government entities, with each entity having one of the multiple combinations of recess placements.

Likewise, the smaller rods 46, 47 and 48 may be positioned at differing positions around the wrench head 45 to match the configuration of the recesses in bolt head 43*b*. Also, the number of recesses may be diminished to one or two and may be increased to 4, 5, 6 etc. With these combinations, and with changing the bolt head size from that of ¼ inch, 5/16, ⅜ etc. or 10 mm, 12 mm, etc., a myriad of municipality or utility specific bolts may be utilized in a secure fashion.

Referring to FIGS. 2 and 6-9, a second embodiment of the sewer cover lock of the present invention, generally indicated at 50, is used on what is referred to as "concealed pickhole" manhole covers and their housings. Such a manhole cover is shown, generally at 51 and its housing at 52 in FIG. 2. On some such covers, a second identical recess (not shown) may be positioned 180 degrees from the recess shown. A U-shape recess 53 inwardly adjacent the circumference of manhole cover 51 approximates 1⅞×1¾ inches. The radial depth of the recess 53 is smaller than the radial length of the inner ledge 54 of housing 52 such that when one looks at the recess 53 one does not see the recess goes completely through the manhole cover and the housing. However, such recesses include an additional internal pocket, shown at 55 which can facilitate the use the curved end of a pry bar (not shown) to lift the manhole cover 51 from its housing 52. This inner pocket 55 forms at one end thereof a diagonal surface which applicant's manhole cover lock 50 utilizes to its benefit.

Referring to FIGS. 6-9, the second embodiment of the manhole cover lock of the invention, generally indicated at 50 includes a body 56 which, in this preferred embodiment, is a generally rectangular metal block wherein two of what would be its side surfaces form a single convex side 57, to be discussed in more detail below. On top of the body 56 is positioned an enlarged flat cover plate 58 made of hardened or spring steel similar to the cover plate 20 of the first embodiment, with the exception that one end of same is bent downwardly along edge 59 to provide a vertical wall 60. A pivot bolt 61 is positioned generally centrally through the body 56 and may be fixedly or threadedly attached to L-shape latch 63 positioned below the bottom of body 56. The head 62 of bolt 61 may be turned through aperture 64 in top plate 58. The height of side plate 60 approximates the height of the combination of body 53 and the height of latch 63 positioned below the body 53. As shown most clearly in FIG. 2, when the second embodiment of the manhole cover lock 50 of the invention is positioned in recess 53, the extended foot 63*a* of L-shape latch 63 extends at right angles from the body of latch 63 and may have a curved outer surface. When latch 63 is turned 90 degrees the body is shaped to further turning. A threaded latch bolt, if utilized, will then draw the latch upward to more tightly engage the recess surface 55 of the manhole cover.

Figure 2:
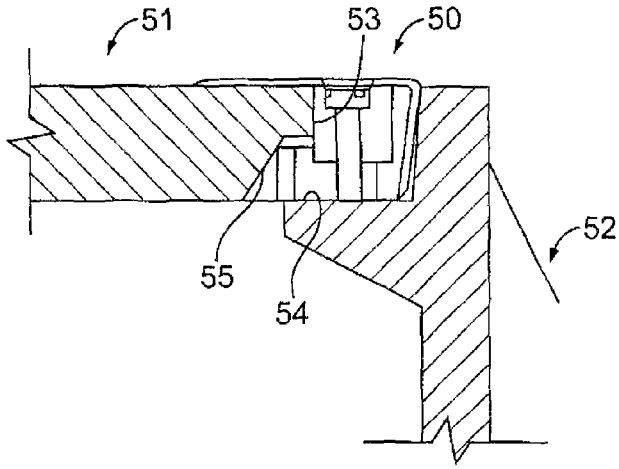
FIG. 2 is an enlarged fragmentary vertical sectional view of a second embodiment of the present invention fitted into a manhole cover and housing of smaller access opening dimensions than that of the first embodiment shown in FIG. 1.
Figure 7:
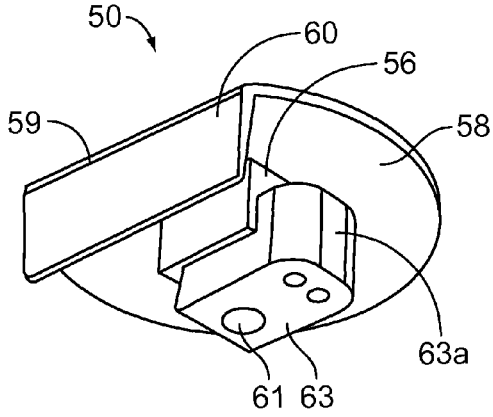
FIG. 7 is a bottom ¾ perspective view of the second embodiment of the present invention.

In operation, as shown in FIG. 2, the second embodiment of the invention 50 is positioned as shown in FIG. 7 with its L-shaped latch 63 positioned parallel to end plate 60. As such, the lock is positioned in the recess 53 in the "concealed pickhole" manhole cover 51 so that the bottom of the plate 58 rests on the cover and the end plate 60 rests against the inside and bottom of the rim on housing 52.

Figure 8:
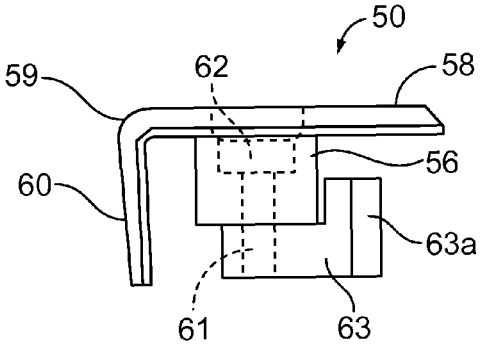
FIG. 8 is an end elevational view of the second embodiment of the present invention.
Figure 9:
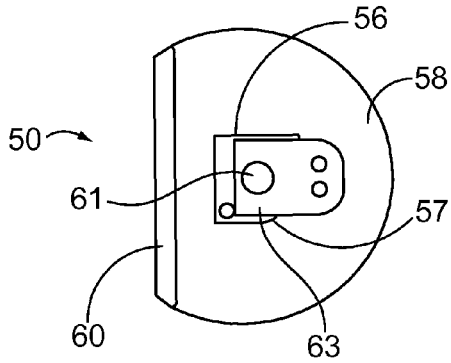
FIG. 9 is a bottom plan view of the second embodiment of the present invention.

Next, a wrench is inserted in aperture 64 so as to drivingly engage the bolt head 62. With the bolt head turned 90 degrees from FIG. 7, as shown in FIGS. 8 and 9, the upper distal end of the face 63*a* of the foot portion of latch 63 will preferably engage the slanted face 55 of the pocket portion of recess 53. The latch is then turned so as to tightly engage the pocket surface whereupon the upper corner of face 63*a* will push the lock radially outwardly against the inside edge of the rim of housing 52. The lock works with radial force against both the cover and the housing. With a pair of such locks in 180 degrees opposing relation on the manhole cover 51, the cover is securely maintained on the rim. Also, any slack between the rim and manhole cover may be taken up by wedge shape shims, as they are known in the trade, sized about 2 inches by 1 inch, wedged in thickness from about 1/16 to 1/8 inch, both before or after the second embodiment 50 of the lock of the invention is latched into securement.

While two embodiments of the present invention has been shown and described, it will be apparent to those skilled in the art that many changes and modifications may be made without departing from the true spirit and scope of the present invention. For example, the computer screen may be utilized for presenting advertising to the customer while waiting for certain of the method steps to be completed. It is the intent of the appended claims to cover all such changes and modifications which fall within the true spirit and scope of the invention.

What is claimed:

1. A manhole cover lock comprising:

a body having an outline similar to the shape of an access recess in a manhole cover, a foot or boot portion rigidly extending below said body and shaped to extend under a manhole cover supporting lip on a housing for said manhole cover, latch means rotatably mounted on said body movable from a recessed position inside said outline of said body to an extended position horizontally outside said outline of said body, said horizontal outside position extending under said manhole cover when said lock is positioned in said recess for securing said cover on said housing, and lock cover means adjacent a top of said body and extending horizontally from said body for completely covering said recess and extending over a portion of said manhole cover thereadjacent.

2. The manhole cover lock as defined in claim 1 wherein said latch means includes, a generally rectangular polyhedral latch having a threaded bore adjacent one end thereof, and a bolt rotatably positioned in a vertical bore in said body, the rotation of said bolt both moving said latch from a recessed position to an extended position and also moving said latch axially along said bolt.

3. The manhole cover lock as defined in claim 1 wherein, said lock cover means includes a cover plate secured on a top of said body.

4. A manhole cover lock comprising, a body sized to fit within an access recess on a "concealed pickhole" manhole cover, including a bore therethrough, a latch member positioned adjacent said body, said latch member extending horizontally from said body, bolt means positioned through said bore for retaining said latch member pivotally thereon, said portion of said latch extending from said body being engageable with a wall defining a pocket on said access recess, a cover plate mounted on a top of said body and extending horizontally therefrom for completely covering said access recess and extending over a portion of said manhole cover thereadjacent, one of said body and said cover plate being biased against an inside surface of a rim on a manhole housing when said latch member engages said recess pocket wall.

5. The manhole cover lock as defined in claim 4 wherein, said cover plate is bent adjacent a distal end thereof to form a substantially vertical end wall for positioning same against an inner surface of a housing rim, the outward force of said plate against said rim and the inward force of said latch on said wall of said recess pocket maintaining said manhole cover on said housing.

6. The manhole cover lock as defined in claim 4 wherein, said bolt means includes a shank and a generally cylindrical head, said cylindrical head including at least a pair of similar sized recesses extending inwardly from a top and a cylindrical side surface of said head.

7. The manhole cover lock as defined in claim 6 wherein, the radial relation between said recesses on said head of said bolt may be varied to inhibit unauthorized turning of said bolt on said body.

* * * * *